United States Patent [19]

Inoue et al.

[11] 4,146,391

[45] Mar. 27, 1979

[54] HIGH-PERMEABILITY MAGNETIC MATERIAL

[75] Inventors: Kiyoshi Inoue; Hideo Kaneko, both of Tokyo, Japan

[73] Assignee: Inoue-Japax Research Inc., Yokohama, Japan

[21] Appl. No.: 839,885

[22] Filed: Oct. 6, 1977

[30] Foreign Application Priority Data

Oct. 7, 1976 [JP] Japan ..... 51-119847

[51] Int. Cl.[2] ..... C22C 38/02; C22C 38/05

[52] U.S. Cl. ..... 75/124; 75/125; 148/31.55

[58] Field of Search ..... 75/124, 125, 123 L, 75/123 J; 148/101, 100, 31.57, 31.55

[56] References Cited

U.S. PATENT DOCUMENTS

| | | | |
|---|---|---|---|
| 2,193,768 | 3/1940 | Masumoto et al. | 75/124 |
| 2,859,143 | 11/1958 | Nachman et al. | 148/2 |
| 2,992,474 | 7/1961 | Adams et al. | 428/928 |
| 4,065,330 | 12/1977 | Masumoto et al. | 75/124 |

*Primary Examiner*—Arthur J. Steiner

*Attorney, Agent, or Firm*—Karl F. Ross

[57] ABSTRACT

A rollable or plastically deformable Sendust-type magnetic alloy containing by weight 3 to 8% aluminum, 4 to 8% silicon, 0.1 to 2% niobium or tantalum or mixture thereof, 0.5 to 7% a mixture of vanadium and copper and the balance iron. The alloy is especially suitable for use with high-frequency inputs.

4 Claims, 2 Drawing Figures

HIGH-PERMEABILITY MAGNETIC MATERIAL

FIELD OF THE INVENTION

The present invention relates to a high-permeability magnetic alloy and, more particularly, to an improved aluminum/silicon/iron magnetic alloy composition.

BACKGROUND OF THE INVENTION

The aluminum/silicon/iron alloy containing by weight 4 to 8% aluminum, 6 to 11% silicon and the balance iron is called commonly Sendust and is known as an excellent "soft" magnetic material having a high permeability, a desirable hardness and a large electric resistivity.

Because of these characteristics, it is highly suitable, for instance, as magnetic-head core materials, especially with high-frequency inputs and where wear resistance is important. Because of its hardness and brittleness, however, this alloy has the disadvantage that it is not plastically machinable. For this reason, the practice used heretofore to fabricate flakes of the Sendust alloy is to mechanically slice a cast ingot of the alloy into pieces and then to grind each piece into a desired thickness. Because of the brittleness of the alloy, however, the slicing and finishing procedure unavoidably gives rise to chipping and, as a consequence, the yield of satisfactory products has been relatively low.

Another method practiced is to comminute a cast ingot into a powder of a particle size, say, in the order of 10 microns and then to compact a mass of the powder with a binder under application of a pressure which must be as high as 18 to 21 tons/cm$^2$ to obtain a desired product of the alloy. These procedures, too, are relatively complicated and have made the products expensive.

OBJECTS OF THE INVENTION

It is, therefore, the object of the present invention to provide an improved aluminum/silicon/iron (Sendust-type) magnetic material whereby the above-mentioned difficulties are overcome.

A more specific object of the invention is to provide an improved magnetic alloy of the type defined and which is malleable and rollable.

SUMMARY OF THE INVENTION

In accordance with the present invention, there is provided an improved magnetic alloy containing by weight 3 to 8% aluminum, 4 to 8% silicon, 0.1 to 1% niobium or tantalum or a combination of both, 0.5 to 7% a mixture of vanadium and copper and the balance iron.

It has already been discovered, as taught in the copending patent application Ser. No. 694,969 of the same assignee of the present application, that the incorporation of a niobium component (i.e. the niobium alone or in combination with tantalum) into the base alloy system is effective to render the alloy malleable and rollable. While, thus, a greater amount of niobium is desirable from the point of view of malleability and rollability, however, it has been found that a lesser amount of this additive is desirable where the effective magnetic permeability to inputs, especially, in a moderate frequency range, say not exceeding 1 kHz, is to be retained at a desired value.

It has now been discovered that an aluminum/silicon/iron-base (Sendust) magnetic material is obtained which has excellent permeability and an increased malleability or rollability, i.e. in excess of 1.5 times and even more than 2 times, greater than those obtainable with the addition of niobium (with or without tantalum) when the alloy contains, in addition to the niobium component, a mixture of vanadium and copper of a proportion in the range specified. Thus, the new magnetic material is capable of rolling with a rollability in excess of 90% and even more than 95%, the rollability being defined by (initial thickness — final thickness)/(initial thickness)$\times$100 of a body rolled by a rolling machine.

The total content of the vanadium/copper mixture in the alloy should range, preferably, between 0.5 and 5% and, still preferably, between 0.8 and 3%. Each individual component of vanadium and copper in the alloy preferably ranges between 0.4 and 2%. (The percentage of compositions used throughout the present specification is to weight percentage.)

SPECIFIC DESCRIPTION AND EXAMPLE

Details of the invention will now be described with reference to embodiments thereof.

Figure 1:
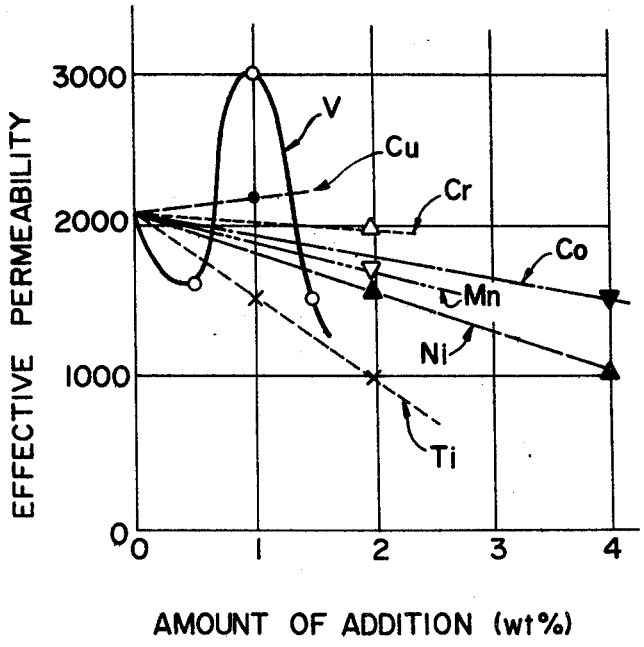
FIG. 1 is a graphical representation of the amount of addition of various components to an exemplary silicon/aluminum/iron alloy containing a niobium component versus the effective permeability of resulting alloys.

From FIG. 1, which shows the effect on permeability of addition of various components to Fe-7%Al-5%Si-0.5%Nb, it is seen that the addition of vanadium or copper and, especially of around 1% vanadium is effective to achieve an enhanced effective permeability. It is seen that titanium, nickel, manganeze, cobalt and chromium are all disadvantageous or inefficient as an additive to provide a niobium-containing aluminum/silicon/iron-base magnetic material with an enhanced or satisfactory permeability.

Figure 2:
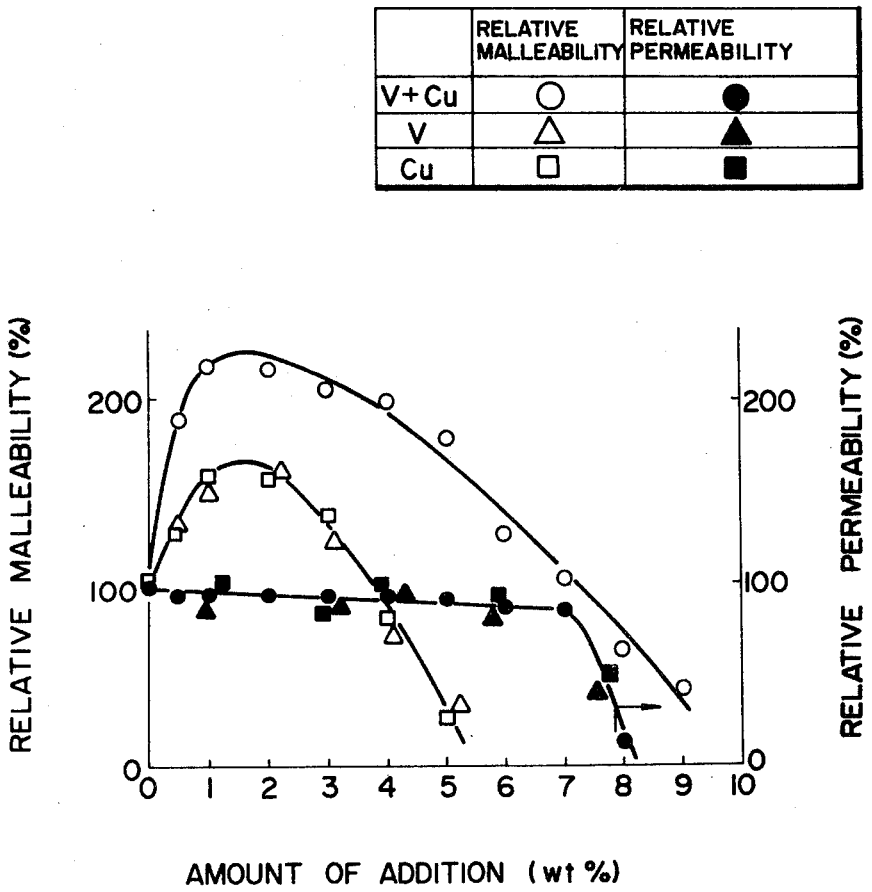
FIG. 2 is a graphical representation of the amount of addition of vanadium and copper each alone and in combination to an exemplary silicon/aluminum/iron alloy containing a niobium component versus the malleability and effective permeability of resulting alloys.

FIG. 2 shows the effect on product performances of the combined addition of vanadium and copper. In this FIGURE, the amount of addition of vanadium, copper and vanadium plus copper to Fe-6%Al-5%Si-0.5%Nb is plotted along the abscissa and the malleability or rollability and the effective permeability of resulting alloys both relative to the rollability and the effective permeability of the alloys containing neither of vanadium and copper is plotted along the ordinate. In this FIGURE, the curve drawn along plain circles represents the relative malleability (defined by the relative rollability) of alloys containing both vanadium and copper in an equal amount whereas the curve drawn along black circles represents the relative effective permeability of the same alloys. Similarly, curves with plain and black triangles represent relative malleability and permeability when only vanadium is incorporated and curves with plain and black squares are in case where only copper is included.

From FIG. 2, it is seen that when the alloy contains vanadium and copper in a total amount of 0.1 to 7%, its malleability exceeds that of the alloy without them. The enhancement of the malleability is particularly remarkable with vanadium and copper added in a range between 0.5 and 5%. The enhanced malleability is shown to be a maximum when the added amount of vanadium and copper ranges between 0.8 and 3%. Thus, the vanadium plus copper containing aluminum-silicon-iron-niobium alloy is seen to have a malleability as expressed in rollability (defined in the foregoing) greater than 90% and, even more than 95%.

The same FIGURE shows that when the alloy contains vanadium and copper in a total amount of 0.1 and 7%, its permeability is substantially same as that of the alloy without them. As the content of vanadium and copper exceeds 7%, the permeability drops sharply. Thus, with the addition of both vanadium and copper in a total amount between 0.1 and 7%, the alloy has an increased malleability without decrease in its permeability. When either of vanadium or copper is included, there is seen an increase in malleability when their content ranges between 0.2 and 3.5% and the value of permeability is substantially same as that of the alloy containing both vanadium and copper. The malleability of the alloy containing copper is slightly higher than the alloy containing vanadium.

It is thus concluded that when the alloy contains both vanadium and copper, especially in a range specified there is a sharp increase in its malleability not obtainable with the addition of either of them alone and yet with the retention of excellent magnetic permeability.

Although the invention has been described in places with reference to the addition of niobium alone to the aluminum/silicon/iron base alloy in combination with vanadium and copper, it should be noted that the niobium component specified may be so reworded that it contains 0 to 99% by weight tantalum and the balance niobium. More specifically, niobium and tantalum in nature co-exist in affinity and have similar physical and chemical properties to each other. In fact, the niobium material in the described embodiments of the invention contain 2 to 3% by weight tantalum and the balance niobium. At present, it is quite expensive to obtain purer niobium or tantalum other than the afore-mentioned mixture. It has been confirmed that substantially same results are obtained using a tantalum material containing several % by weight niobium. Accordingly, the possible incorporation of niobium in the alloys as 0.1 to 1% by weight also means 0.1 to 1% by weight of a combination of niobium and tantalum.

We claim:

1. A magnetic material consisting by weight of 3 to 8% aluminum, 4 to 8% silicon, 0.1 to 2% niobium or tantalum or a combination thereof, 0.5 to 7% a combination of vanadium and copper and the balance iron, the material having a rollability in excess of 95% as measured by $(IT-FT/IT) \times 100$ where FT is final thickness and IT is initial thickness of the rolled material.

2. The material defined in claim 1 which contains 0.5 to 5% by weight a combination of vanadium and copper.

3. The material defined in claim 2 which contains 0.8 to 3% by weight a combination of vanadium and copper.

4. The material defined in claim 1 which contains 0.4 to 2% by weight each of vanadium and copper.

* * * * *